US006674990B2

(12) United States Patent
Rohde et al.

(10) Patent No.: US 6,674,990 B2
(45) Date of Patent: Jan. 6, 2004

(54) OVERHEATING PROTECTION FOR TONER IMAGE PRINTED SUBSTRATE IN A RADIATION FIXING DEVICE

(75) Inventors: Domingo Rohde, Kiel (DE); Frank-Michael Morgenweck, Molfsee (DE); Gerhard Bartscher, Köln (DE)

(73) Assignee: NexPress Solutions LLC, Rochester, NY (US)

( * ) Notice: Subject to any disclaimer, the term of this patent is extended or adjusted under 35 U.S.C. 154(b) by 0 days.

(21) Appl. No.: 10/023,959

(22) Filed: Dec. 18, 2001

(65) Prior Publication Data

US 2002/0118986 A1 Aug. 29, 2002

(30) Foreign Application Priority Data

Dec. 22, 2000 (DE) ..... 100 64 553
Jul. 24, 2001 (DE) ..... 101 35 864

(51) Int. Cl.[7] ..... G03G 15/20
(52) U.S. Cl. ..... 399/336
(58) Field of Search ..... 399/320, 335, 399/336, 337; 219/216; 432/60

(56) References Cited

U.S. PATENT DOCUMENTS

| | | | | |
|---|---|---|---|---|
| 4,183,654 A | * | 1/1980 | Waschk et al. | 399/336 |
| 4,452,524 A | * | 6/1984 | Parisi | 399/336 |
| 5,448,344 A | | 9/1995 | Itakura et al. | |
| 5,887,238 A | * | 3/1999 | Matsuzoe et al. | 399/336 |
| 5,974,296 A | * | 10/1999 | Suketomo et al. | 399/336 |
| 6,427,061 B1 | * | 7/2002 | Miura et al. | 399/336 |

FOREIGN PATENT DOCUMENTS

| | | |
|---|---|---|
| DE | 26 33 019 A1 | 1/1978 |
| DE | 43 39 338 C2 | 1/1993 |
| DE | 43 39 338 A1 | 9/1994 |

* cited by examiner

*Primary Examiner*—William J. Royer
(74) *Attorney, Agent, or Firm*—Lawrence P. Kessler

(57) ABSTRACT

A digital printer or copier machine (1) and a device (23) for protection against excessive heating of an object (5, 49), for example, a paper to be printed, that is guided past a radiation device (7) within a digital printer or copier machine (1). The protection device (23) has two protection elements (41, 43) permeable to radiation and arranged at a distance from each other, which are arranged in the radiation path (21) between a radiation device (7) and the object to be heated (5, 49).

21 Claims, 5 Drawing Sheets

OVERHEATING PROTECTION FOR TONER IMAGE PRINTED SUBSTRATE IN A RADIATION FIXING DEVICE

FIELD OF THE INVENTION

The invention involves a digital printer or copier machine with an overheating protection device.

BACKGROUND OF THE INVENTION

For certain commercial printer or copier machines, a latent electrostatic image is developed by charged toner particles. These particles are transferred onto an image receiving substrate, hereinafter referred to simply as "substrate". Afterwards, the developed image that has been transferred onto the substrate is fixed by the toner particles being fused by supplying them with heat. This operation occurs in a fixing device.

Fixing devices are known in which hot cylinders or rollers are used to fix the toner onto the substrate or in order to preheat the substrate that may already have the toner image. The heating of the hot, customarily hollow cylindrical fixing rollers is done from the inside via their inner sheath surface and/or from the outside using at least one heated auxiliary roller that is in rolling contact with the fixing roller, or at least one radiation device that impinges the fixing roller with electromagnetic radiation. Furthermore, fixing devices are known in which the fixing of the toner image and possibly, the preheating of the substrate, is started directly by a radiation device without an intermediate connection of fixing rollers, and by using them, the toner can be fused in a non-contact manner.

The known radiation devices have at least one lamp that, for example, radiates ultraviolet light and visible or infrared light. The known lamps customarily have a quartz glass bulb that can heat up to 800° C. when the radiation device is turned on. Furthermore, ceramic radiators are known that have temperatures up to 1200° C. on their outer side. Disadvantageous in the previously described radiation devices based on their very high temperatures is that there is a danger of fire. This danger occurs especially during a paper jam, when the substrate that consists of paper, for example, is arranged opposite the radiation device (then turned off) and exposed to its heat radiation. The paper can start to arch as a result so that it comes into contact with the lamp, or parts heated up by it, and can ignite in the process. Furthermore, there is the possibility that the paper has a deformation, such as a dog-ear, whereby contact can also occur between the paper and the radiation device.

DESCRIPTION RELATIVE TO THE PRIOR ART

In order to prevent contact between the paper and the radiation device, devices are used to protect the substrate from excessive heating. From the U.S. Pat. No. 5,068,684, a protection device is provided with flaps arranged in a radiation path of a radiation source. These flaps can be moved into an open and closed position. As soon as the radiation source is turned off, the flaps are closed in order to shield the paper arranged in the radiation path from the heat radiation.

A protection device with rotationally movable sealing flaps and/or screens is provided in U.S. Pat. No. 6,085,060.

From the patent DE 2298 18 588 U1, a fixing device for an electrophotographic printer or copier device is known, in which to protect the paper to be printed from excessive heating, a radiation device is used which is constructed in two parts. The two parts are constructed so that they can be positioned crosswise to the paper transport device. The fixing device is controlled in such a way that during a paper stop, the two parts of the radiation device are driven far enough apart from each other in opposite directions, so that the paper no longer is impinged by their heat radiation.

Based on the constructive embodiment, in particular because of their movable screens, flaps, and/or parts of the radiation devices, the previously described protection devices have an expensive and thus cost intensive design. Furthermore, they are susceptible to damage and require an increased maintenance expense.

From U.S. Pat. No. 4,019,054, a fixing device that has a radiation device is known in which a fixed metal plate arranged opposite the radiation device is located in the radiation path. The metal plate, which is completely solid, has a prearranged intake area, as seen in the transport direction of the substrate that is passed by it. In the intake area, the substrate should be preheated. An outlet area follows this, in which many throughput openings that have a large open cross section are made in the metal plate, so that the electromagnetic radiation penetrates the metal plate in an almost unhindered manner and the substrate with the toner image can heat up. It is a disadvantage in this device that the metal plate is heated so much by the radiation device that the paper can ignite upon contact with it.

SUMMARY OF THE INVENTION

The purpose of the invention is to provide a printer or copier machine and a protection device, in which a contact between the substrate and the radiation device can be practically ruled out. Furthermore, the protection device should have a simple and thus cost effective design.

In order to achieve this purpose, a printer or copier machine is proposed which has a fixing device for fixing a toner image onto a substrate, for example a paper sheet or a paper web, and is guided along a transport path. The fixing device contains at least one radiation device, by the use of which at least one side of the substrate can be impinged with electromagnetic radiation. Finally, a device for protection against excessive heating of the substrate, especially during an interruption of the substrate transport, is provided. The printer or copier machine is characterized in that the protection device has at least one stopper arranged fixed in the radiation path between the radiation device and the transport path of the substrate, which prevents a contact between the substrate and the radiation device. The stopper is thus constructed in such a manner according to the invention that, for example, when the substrate arches up in the direction of the radiation device or if there is a bend in the substrate, it stops on the stopper. In this way, it can be ensured that the substrate cannot ignite on the turned off radiation device or by parts of the machine heated by it during its normal operation.

In relation to the invention presented, the term "fixed" is understood to mean that the stopper is installed in a housing or the like in such a way that its position does not change within the printer or copier machine. This means the stopper can not be moved relative to the substrate transport plane and the radiation device, but instead is arranged fixed in location and thus in the installed condition is always located in the radiation path, both during the fixing of the toner image on the substrate and during an interruption of the substrate transport. The protection device, differing from the known protection devices, has no movable parts in the sense of, for example, parts that can rotate or tilt, and thus represents a passively acting solution for the protection of the substrate against excessive heating and ignition as a result of a contact between the substrate and the radiation device and/or parts heated by it. Because of its simple construction, the protection device according to the invention can be manufactured in a cost effective manner. Moreover, a compact and space saving construction is possible.

It is noted that an ignition of the substrate can only be ruled out with certainty if the radiation device is turned off quickly and safely during a substrate stop and if necessary, when the speed of the substrate has fallen below a certain, preferably adjustable, substrate transport speed. This is usually done automatically. As of that moment, the stopper and the substrate arranged in the radiation path are then only still impinged with the heat radiated off of the hot parts of the radiation device or other structural parts of the machine heated in the operation of the radiation device.

The stopper arranged in the radiation path is constructed in such a way in a preferred embodiment form that it does not prevent the fusing of the toner image. For this purpose, it is arranged at a distance from the substrate transport plane so that in the normal print and/or copier operation of the machine, the substrates are guided by it without coming into contact with the stopper in the process. The stopper is then only effective if a substrate stop occurs within the fixing device and the substrate becomes arched and/or arches in the direction of the radiation device as a result of excessive heating. Preferably, the radiation absorption of the stopper is only low when a radiation device is turned on.

In a preferred embodiment form, the stopper is formed from at least one mesh structure that lets the electromagnetic radiation radiated out by the radiation device in the direction of the substrate to pass through it in an approximate unhindered manner. The mesh structure has a sieve or net type structure, whereby the width of its mesh is relatively large. In each case, the meshes are at least so small, however, that a substrate with a bent corner (dog-ear), also stops on the mesh structure when the substrate arches up in the direction of the radiation device, for example, so that a contact between the substrate and the radiation device, especially between the quartz glass of the lamp, possibly, a reflector surrounding the lamp, or otherwise by the parts of the machine heated when the radiation device is turned on, is prevented with a large degree of certainty.

The mesh structure preferably having only a small thickness is constructed so that it is planar, i.e., it has two flat sides like a plate and is arranged in the radiation path either parallel to the substrate transport plane or inclined towards it. The arrangement of the mesh structure in any case is such that the flat side of the mesh structure facing towards the substrate transport plane forms the stopper surface for the substrate. Of course, several layers of the mesh structure could also be used.

According to a further embodiment of the invention, the material of the mesh structure has only a low heating capacity and/or only a low heat conductivity. The low heating capacity and heating conductivity of the mesh structure is an advantage to the extent that the substrate, upon contact with the mesh structure, does not ignite by the heat stored by the mesh structure.

Especially preferred is an embodiment example of the machine, which is characterized in that the mesh structure is formed from at least one mesh braid. The mesh braid is made out of individual threads that are woven, linked, or in any other way preferably detachably connected together. In another embodiment variation it is provided that the "threads" are connected to each other so that they are at least partially undetachable; for example, the threads can be fused together, adhered, soldered, or in another way firmly connected. In this case, the mesh braid has a grid structure. Preferably, the mesh braid is very wide meshed, i.e., it has a large mesh width, which for example, can be 10 mm and less. In each case, the meshes are only so large, however, that as mentioned contact between the radiation device that has been turned off in the event of a malfunction and the substrate that arches up in the direction of the radiation device can be ruled out with certainty.

The threads can be made out of a wide range of materials that have the properties described above with regard to the heat conductivity and heat capacity. The threads can, for example, be made out of a suitable metal, heat resistant plastic, glass and/or carbon fibers. Gold coated tungsten wires that have a diameter of approximately 100 $\mu$m or smaller have proven to be especially preferred. It is also readily possible to use wires with a diameter of larger than 100 $\mu$m. Provided the mesh structure is not a mesh braid, but instead for example, is a plate or sheet that is provided with openings having a very small diameter, metal can also be used for this purpose, in particular tungsten, heat resistant plastic, or the like.

Furthermore, an embodiment example of the invention is preferred in which the at least one stopper is formed from a thin, preferably sheet like plate, which is arranged fixed in the radiation path and at a distance from the transport plane of the substrate.

According to a first embodiment variation, the plate "stands" almost on edge on the substrate transport plane, i.e., its flat sides run perpendicularly to the transport plane. Because of this arrangement, the surface covered by the plate in the radiation path is extremely small and the large portion of the electromagnetic radiation radiated from the radiation device radiates past the plate onto the substrate transport plane. Because of this arrangement, the boundary edge of the plate facing towards the substrate transport plane forms the surface that stops the substrate and that is only very small. The plate is oriented in a preferred embodiment form in the transport direction of the substrate, i.e., the flat sides of the plate run at least essentially parallel to the substrate transport direction. Of course, it is also possible that the at least one plate running perpendicularly to the transport plane, runs at an angle or crosswise to the transport direction. It is important that if the substrate leaves its transport plane, whether by a deformation, for example, arching as a result of excessive heating, or any other deformation, for example, a bent edge, it stops on the at least one plate and does not come into contact with the radiation device.

According to a second embodiment variation, the plate is inclined by a certain angle, as seen relative to the substrate transport plane in and/or crosswise to the transport direction of the substrate, so that the electromagnetic radiation radiated out from the radiation device has a minimal interaction area with the plate.

In all embodiment forms of the plate that functions as the stopper, it is common that they consist of a temperature resistant material, and that they are preferably not deformed or damaged when the radiation device is turned on. Provided the electromagnetic radiation has a UV portion, preferably a material is used that is resistant against ultraviolet radiation.

The object of the invention also involves a device for protecting an object that is guided past a radiation device against excessive heating, whereby the protection device has at least one stopper arranged fixed in the radiation path between the radiation device and the object to be heated. The protection device can be used for a digital printer or copier machine. The object to be protected is, for example, a substrate that should be preheated using the radiation device or that has an unfixed toner image that is fused using the radiation device.

Therefore, to achieve the purpose of the invention, a digital printer or copier machine is proposed characterized in that the protection device has at least two protection elements that are permeable to electromagnetic radiation and arranged in the radiation path between the radiation device and the transport path of the substrate and at a distance from each other. The radiation device is located on one side of the first protection element, while the substrate transport plane is located on an opposite side of the second protection element. The intermediate space between the protection elements is preferably free of installed parts. The protection elements are preferably constructed in such a way that when the radiation device is turned on, the radiation output arriving onto the toner image that is transferred onto the substrate still is up to 95% of the radiation output given off by the radiation device, whereas when the radiation device is turned off, the remaining heat radiation is almost completely absorbed by the protection elements and, in the end, only a small heat quantity, for example, only approximately 10% of the initial energy of the residual heat radiation of the radiation device, arrives at the substrate. Because of these properties, the heating of the second protection element that functions, among other things, as a stopper for the substrate, is only relatively low so that upon contact between the second protection element and the substrate, the substrate can not ignite on the second protection element. If necessary, for this purpose, the second protection element can be cooled for this purpose, for example, using air. The largest part of the energy of the residual heat radiation when the radiation device is turned off is thus received by the first protection element, whose temperature can thus be noticeably above the temperature of the first protection element. The protection elements act almost as a filter for the electromagnetic radiation in a wavelength range which corresponds to that of the residual heat radiation of the radiation device that is turned off.

In an especially preferred embodiment form, the protection elements are each formed from at least one plate, and each plate consists of a material such as quartz glass that is permeable to electromagnetic radiation. The plates can each be completely solid, i.e., their flat sides have no openings or other passages through them. When the radiation device is turned on, its emitted electromagnetic radiation must thus penetrate through the at least two plates in order to get onto the toner image. The plates are preferably arranged parallel to each other and to the substrate transport plane.

In an especially preferred advantageous embodiment example, it is provided that the protection elements that are plate shaped or each formed from at least one light permeable plate consist of a material that lets through electromagnetic radiation at a wavelength $\lambda$ from approximately 0.2 $\mu$m to approximately 6 $\mu$m, preferably from 0.2 $\mu$m to 3.5 $\mu$m, and in particular from 0.2 $\mu$m to 2.5 $\mu$m. The protection elements thus function as a filter for the electromagnetic radiation, so that only a certain radiation spectrum is permitted through to the substrate.

According to the invention it is planned that the radiation device, when it is turned on, preferably radiates ultraviolet light, visible light or near infrared light, whereby the largest part of the radiation energy is allowed through to the substrate by the protection elements/plates according to the invention. When the radiation device is turned off, the protection elements are still impinged by the heat radiation (in particular, infrared to far infrared) of the structural parts heated by the radiation device, for example, the quartz glass structure of the radiation source. This radiation is as mentioned however, for the most part absorbed by the protection elements, in particular, by the first protection element arranged opposite the radiation device.

The protection elements can be manufactured out of the same material or out of different materials. As a material for the protection elements, quartz glass can be used, for example.

In an advantageous embodiment example, the intermediate space between the protection elements can be flushed by a gaseous medium, especially air, functioning to cool the protection elements. The air functions both for the cooling of the first as well as the second protection element.

According to an additional embodiment of the invention it is provided that the protection elements are arranged fixed relative to the transport plane of the substrate and/or the radiation device. The protection elements thus have a fixed, constant position within the radiation path, and thus must not, when there is a malfunction of the printer/copier operation, be moved first into the radiation path and then back again into a maintenance position, and this simplifies the construction of the protection device.

Finally, the object of the invention also involves a device, especially for a digital printer or copier machine, for protecting an object guided past a radiation device from excessive heating, which is characterized in that it has at least two protection elements that are permeable to radiation and arranged at a distance from each other, which are arranged in the radiation path between the radiation device and the object to be heated. The object can, for example, be the substrate itself, which is moved as a result of a malfunction out of its transport plane, for example, in which it becomes arched, and stops on the protection element arranged opposite it. It is also conceivable that the object is a cylinder or roller heated on the outside using the radiation device, on the outer sheath surface of which, if necessary, the substrate adheres in an undesired manner and in this way gets out of its transport plane into a position opposite the radiation device. Furthermore, the object can be a conveyor belt that functions for the transport of the substrate. In all cases, the protection elements prevent a direct contact between the object mentioned and the radiation device, whereby the protection element lying opposite the object arranged in the radiation path possibly functions as a stopper. According to the invention, it is provided that the protection element functioning as a stopper is only heated until upon contact between the object, in particular, the substrate, and this protection element, an ignition of the substrate can be ruled out with certainty.

BRIEF DESCRIPTION OF THE DRAWINGS

In the detailed description of the preferred embodiment of the invention presented below, reference is made to the accompanying drawings, in which.

DETAILED DESCRIPTION OF THE PREFERRED EMBODIMENTS

In the following, it is assumed purely for the purposes of example, that the digital printer or copier machine 1 operates according to the electrographic or electrophotographic process and functions in order to fix a liquid or dry toner onto a substrate. The substrate can, for example, be made out of paper or cardboard and be a sheet or a continuous web. It is assumed purely for the purpose of example in the following that the machine 1 functions for printing paper.

Figure 1:
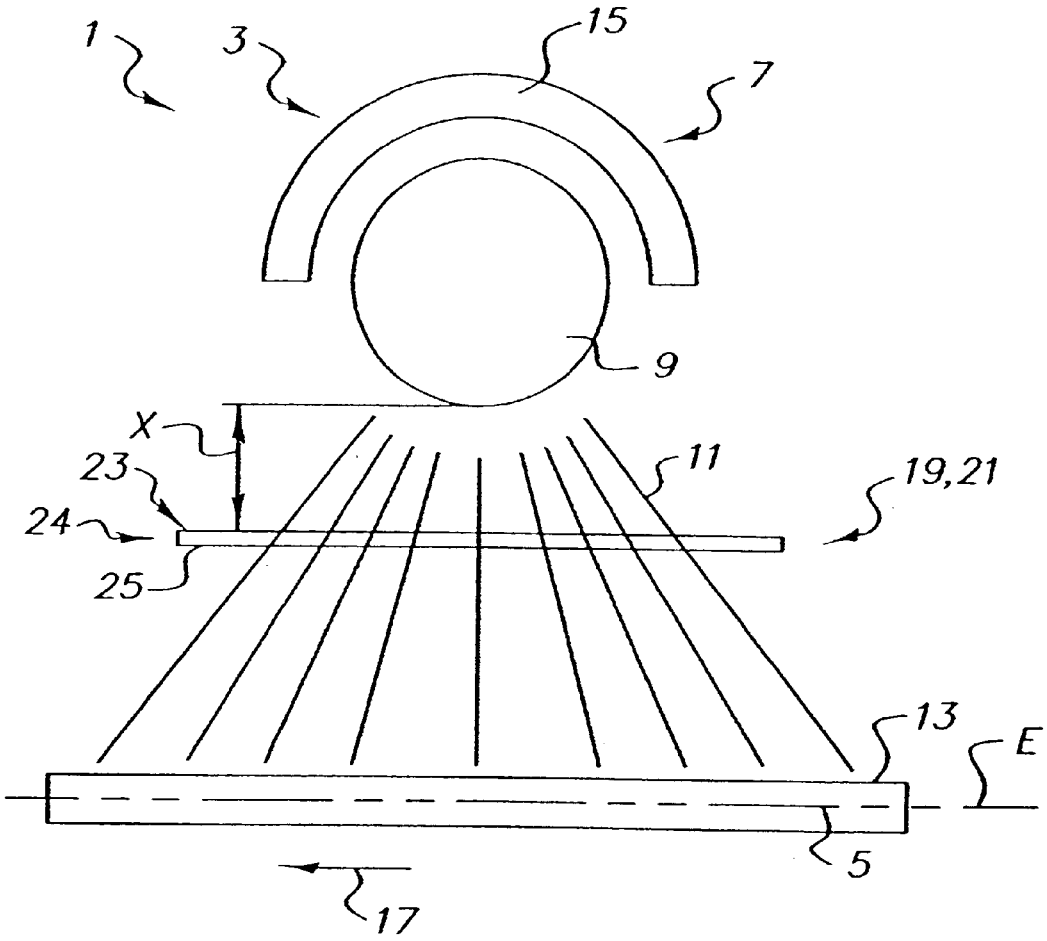
FIG. 1 is a schematic diagram of a first embodiment example of a fixing device for the printer or copier machine according to the invention.

FIG. 1 shows in a schematic diagram a section of the machine 1, namely a fixing device 3, which here contains a radiation device 7 that extends crosswise over the width of a substrate, such as paper 5, to be printed. The radiation device 7 has at least one radiator 9 that functions for the impingement with electromagnetic radiation, i.e., UV to far infrared radiation 11, of a flat side 13 of the paper 5 that has a toner image. The toner image is not shown in FIG. 1, but is located on the flat side 13 of the paper 5 that faces toward the radiator 9. The radiator 9 can be formed from a lamp, for example, that contains a heating wire surrounded by a glass body (bulb). The radiator 9 is surrounded over a part of its outer circumference by a reflector 15, which has an opening to the transport path of the paper 5, through which the UV radiation to far infrared radiation 11 is reflected by the reflector 15 in the direction of the paper 5. The radiation device 7 functions for the purpose of supplying so much heat to the toner image that the toner is fused and adheres to the paper 5 so that after the toner has cooled off, it is adhered to the paper 5.

In another embodiment example (not shown), it is provided that several radiation devices 7, in particular radiators 9, are arranged crosswise over the width of the paper 5, preferably in a row. Of course, it is also possible that in addition or as an alternative to the UV radiation to far infrared radiation 11, one or more radiation devices are used, which impinge the toner image with clock pulsed or constant ultraviolet radiation or the like. Of course, the UV radiation to far infrared radiation 11 can also be clock pulsed or continuously applied onto the toner image.

The paper 5 is guided past a roller or cylinder or the like at a distance from the radiation device 7 using a transport device (not shown), for example, a drivable belt. The transport direction 17 of the paper 5 is indicated in FIG. 1 with an arrow. The transport plane E of the paper is indicated by a dotted line and runs perpendicularly to the image plane of FIG. 1. Here it is parallel to a hypothetical horizontal line.

In the open space 19 between the radiator 9 and the paper 5, which is indicated in the following as the radiation path 21 since the UV radiation to far infrared radiation 11 radiates through this open space 19 to the flat side 13 of the paper 5, a protection device 23 is provided which should protect the paper 5 from excessive heating by the radiator 9. This is the case, for example, if a paper jam occurs and the machine 1 stops the printing/copying operation as a result of an operating malfunction and thus also adjusts the paper transport.

The protection device 23 has a stopper 24, which is arranged fixed in the radiation path 21 and at a distance from the transport plane E and the radiation device 7. The stopper 24 should prevent a contact between the paper 5 and the radiation device 7. In this embodiment example, the stopper 24 is formed by a mesh structure 25, which, for example, is affixed to a housing of machine 1 (not shown) and is not so movable that it is in different function positions, for example, by being pivoted, but instead always stays, after its assembly, in the position shown in FIG. 1 within the radiation path 21, especially during the fixing operation when the radiation device 7 is turned on.

The mesh structure 25 has a grid, net, or sieve like structure, i.e., it has many throughput openings with preferably large cross sections, which are indicated as meshes in the following. The mesh structure 25 consists of a heat resistant material that resists the UV radiation to far infrared radiation 11 of the radiation device 7, i.e., does not deform or burn. As a material for the mesh structure 25, for example, metal, heat resistant plastic, glass fibers and/or carbon fibers come into consideration. In an especially advantageous embodiment example, the mesh structure 25 is made of tungsten. The mesh structure material has only a low heat capacity and/or only a low heat conductivity. By "low" heat capacity it is understood that the heat energy that can be stored by the mesh structure 25 is so low that when there is an interruption of the paper transport, the heat transferred from the mesh structure 25 to the paper 5 is so low that damage or ignition of the paper 5 can be ruled out with certainty. The heat capacity of the mesh structure 25 is furthermore so low that upon contact between the paper 5 and the mesh structure 25, for example, as a result of a paper jam, the energy stored by the mesh structure 25 and/or the temperature of the mesh structure 25 is not sufficient to ignite the paper 5. In any case, a constant distance X between the mesh structure 25 that is fixedly arranged and the radiator 9 is so large that even when the paper 5 stops on the flat side of the mesh structure 25 functioning as a stopper 24 and facing the transport plane E, the residual heat radiation of the heated parts of the radiation device 7 (that is turned off at this point in time in any case), for example, the glass body (bulb) of the lamp, can not ignite the paper 5.

Decisive for the functioning safety of the protection device 23 described in FIG. 1 is that when there is a paper stop, the radiation device 7 is turned off quickly and safely so that only the residual heat radiation of the parts heated when the radiation device 7 is turned on is radiated out into the radiation path 21.

Figure 2:
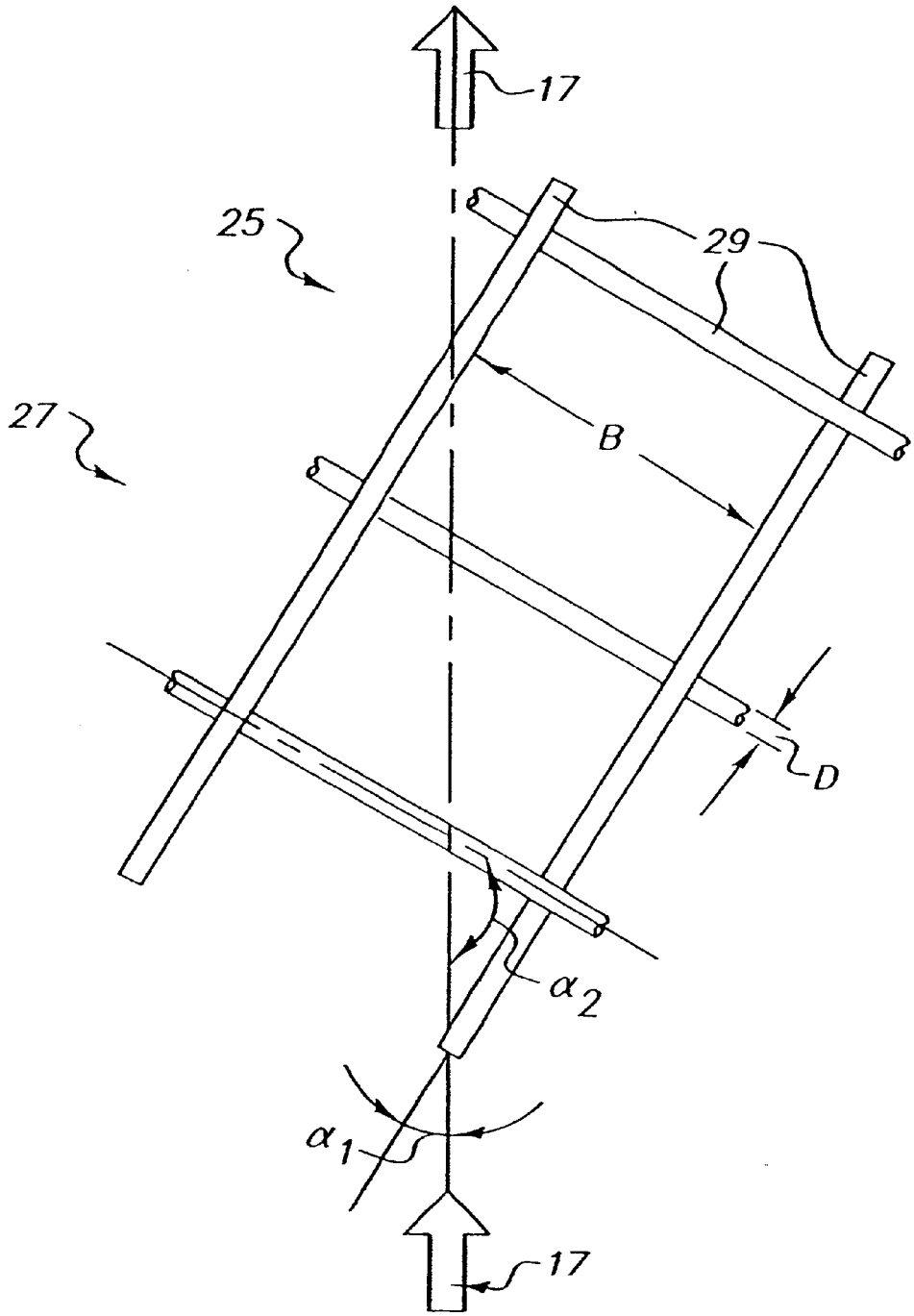
FIG. 2 is a section of an embodiment example of a mesh structure of a protection device in an overhead view.

In the following, an embodiment example of the mesh structure 25 is explained in greater detail using FIG. 2. FIG. 2 shows a greatly enlarged section in an overhead view of the mesh structure 25 shown in FIG. 1, on its flat side that faces away from the paper transport plane E. In other words, below the mesh structure 25, the paper 5 (not shown in FIG. 2) is guided past the fixing device 3 in the transport direction 17. The mesh structure 25 is formed here from a wide meshed mesh braid 27. The threads 29 that are woven and/or braided together have a round cross section, whereby the thread diameter D can be 100 $\mu$m or smaller. The mesh width B can, for example, be 5 mm. The meshes are rectangular as seen in the overhead view, whereby their shape and size can be varied.

As can be seen in FIG. 2, the mesh braid 27 is oriented in such a way relative to the transport direction 17 of the paper 5, that its threads 29 are inclined relative to the paper transport direction 17 by respective angles $\alpha_1$,$\alpha_2$ that are not equal to 90° and not equal to 0°. The threads 29 of the first thread row enclose an angle $\alpha_1$ with the paper transport direction 17, which is approximately 50° here, while the angle $\alpha_2$, which is enclosed by the threads 29 of the second thread row that runs crosswise to the first thread row, is approximately 40°. The threads 29 are preferably always oriented in all embodiment examples of the mesh braid 27 in such a way that they as shown in FIG. 2 do not run parallel to the paper transport direction 17. In this way, a non-homogenous heating of the paper 5 can be ruled out.

In an additional embodiment example not shown in the figures, it is provided that the mesh structure 25 is formed from a thin plate that has throughput openings that have large cross sections and are arranged in a matrix. The mesh structure 25 thus has connection and stays arranged in a grid shape, instead of threads. Also, a mesh structure 25 constructed in this way fulfills the necessary function as a stopper 24 for the paper 5, in order to prevent a contact between the paper and the radiation device 7 or other parts heated by it. It is significant that the mesh structure 25 has a temperature, when the radiation device 7 is turned off, which is so low that an ignition of the paper 5 oh contact can be ruled out.

In order to increase the mechanical resistance of the mesh structure 25, it is provided, in an advantageous embodiment example (not shown in the figures) that the mesh structure 25 consists of several mesh braids 27 lying on top of each other, which are constructed, for example, as described using FIG. 2. The mesh braids 27 can have both identical as well as different thread diameters D and/or mesh widths B and/or they can consist of different materials. The multiple mesh braid formed from the mesh braids 27 that are, if necessary, connected to each other, has such a high stability and rigidity that it also resists the pressure forces acting on it and is not damaged during a paper jam by the paper 5 that has been shoved together at the bottom on the multiple mesh braid 27. Thus, even during a paper jam, a contact of the paper 5, which is shoved together by the transport device, with the radiator 9 can be ruled out with certainty.

In an additional embodiment example (not shown) of the protection device 23, it has a tensioning device, which functions for applying a tensile force onto the threads 29. Preferably, the tensile force is adjustable. By the tensioning of the mesh braid 27, the thermal length extension of the threads 29 is offset. Furthermore, the stability and the rigidity of the mesh braid 27 are improved. The tensioning device can be constructed in such a way that different areas of the mesh braid 27 can be pretensioned differently.

Figure 3A:
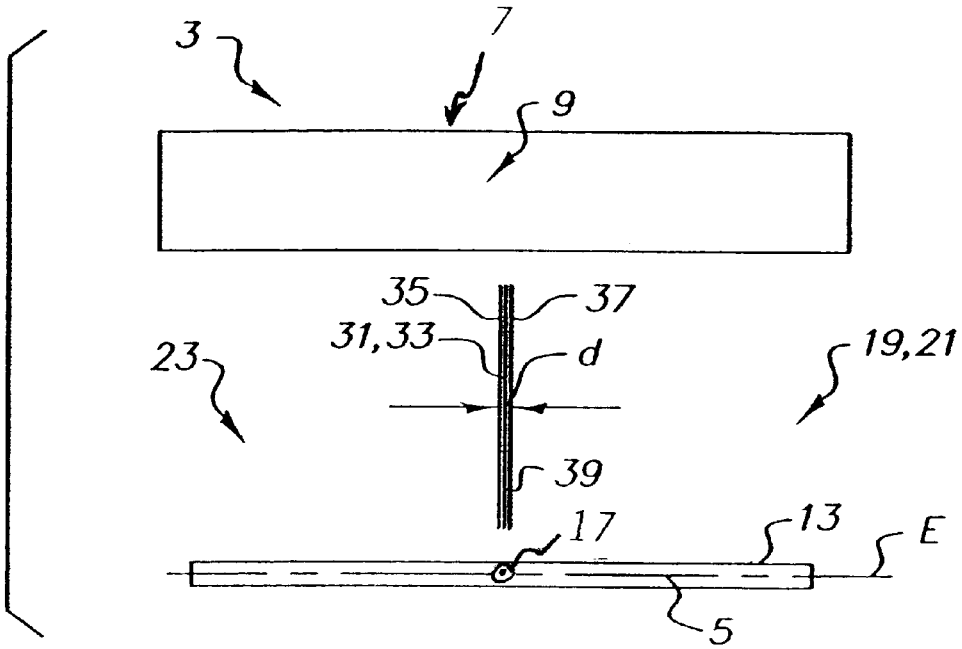
FIGS. 3A and 3B each show a section of another embodiment example of the fixing device with additional embodiment examples of the protection device.

FIG. 3A shows an additional embodiment example of the fixing device 3 with a second embodiment form of the protection device 23 in cross section. Equivalent parts are provided with the same reference indicators, so that reference is made to the description for FIG. 1 in this regard. In the following, only the differences are explained in greater detail. The transport device of the paper runs perpendicularly here to the image plane of FIG. 3A. The protection device 23 has a stopper 31 here, arranged fixed in the radiation path 21 and formed by a thin plate 33. The arrangement of the plate 33 is selected here in such a way that its flat sides 35 and 37 run perpendicularly to the transport plane E of the paper 5, which here spans the image plane of FIG. 3A perpendicularly. Furthermore, the plate 33 that stands on edge is oriented in the transport direction 17.

The two flat sides 35 and 37 of the plate 33 run towards each other on their edge that faces the paper 5, whereby a border edge 39 that runs to a peak is formed. The plate 33 has a thickness d that is only very small, which, for example, can be only a few millimeters or if necessary, also smaller than 1 mm. It is important that the plate 33 covers only a very small area of the radiation path 21 and does not affect the fusing of the toner image located on the paper 5 in a damaging way. Using the stopper 31, it is ensured that if the paper 5 leaves the transport plane E, for example, as a result of a paper jam, the paper 5 hits the plate 33 in the area of the border edge 39 and thus cannot come into contact with the radiation device 7. Because of the only very small area of the border edge 39, the contact area between the paper 5 and the stopper 31 is only very small. The protection device 23 is characterized by an especially simple construction. Since the plate 33 gives almost no active surface for the electromagnetic radiation of radiation device 7 that is turned on and the residual heat radiation when radiation device 7 is turned off, the heating of the plate 33 is correspondingly low. The temperature of the plate 33 is preferably only so high at maximum, that even if there were a flat contact between the paper 5 and the plate 33, an ignition of the paper 5 can be ruled out. In the embodiment example shown in FIG. 3A of the radiation device 7, its radiator 9 is constructed in a bar shaped manner and extends crosswise over the width of the substrate transport path.

Figure 3B:
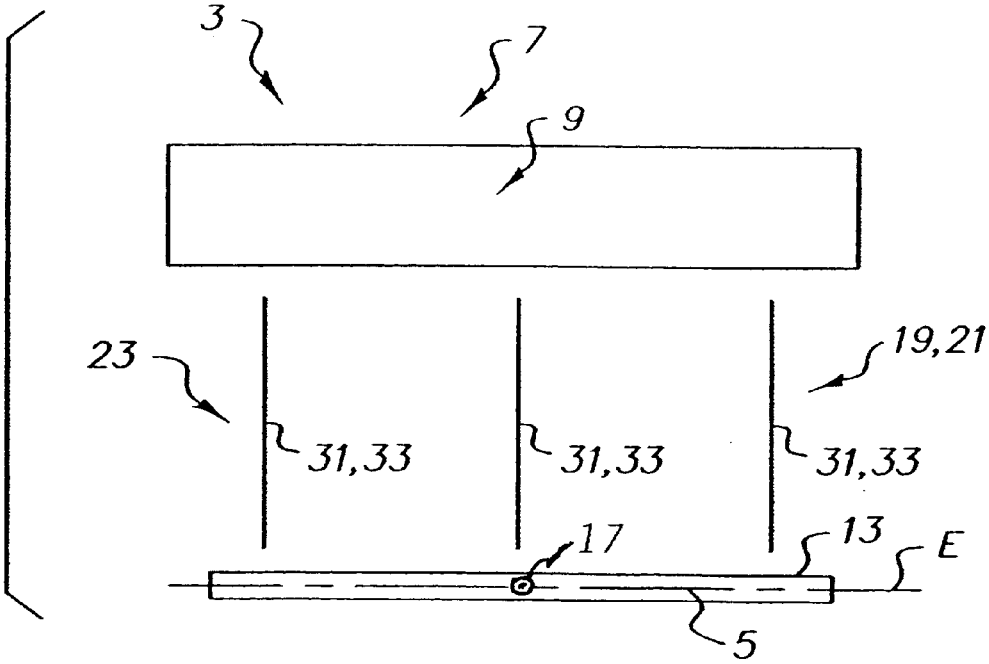

FIG. 3B shows a section view crosswise to the paper transport direction 17 through an additional embodiment example of the protection device 23 described using FIG. 3A. The protection device 23 here has a total of three stoppers 31 each formed from one plate 33 which, as seen in the paper transport direction 17 are arranged next to each other at a distance and are arranged distributed over the paper width. The orientation of the stoppers 31 running parallel to each other is selected here in such a way that their flat sides run in the transport direction 17 of the paper 5 and perpendicularly to the transport plane E. By the stoppers 31 set apart at a distance from each other, a large bend of the paper 5 can be prevented if it arches up, for example, in the direction of the radiation device 7 as a result of excessive heating. In each case, however, a contact between the paper 5 and the radiation device 7 is prevented.

Figure 4:
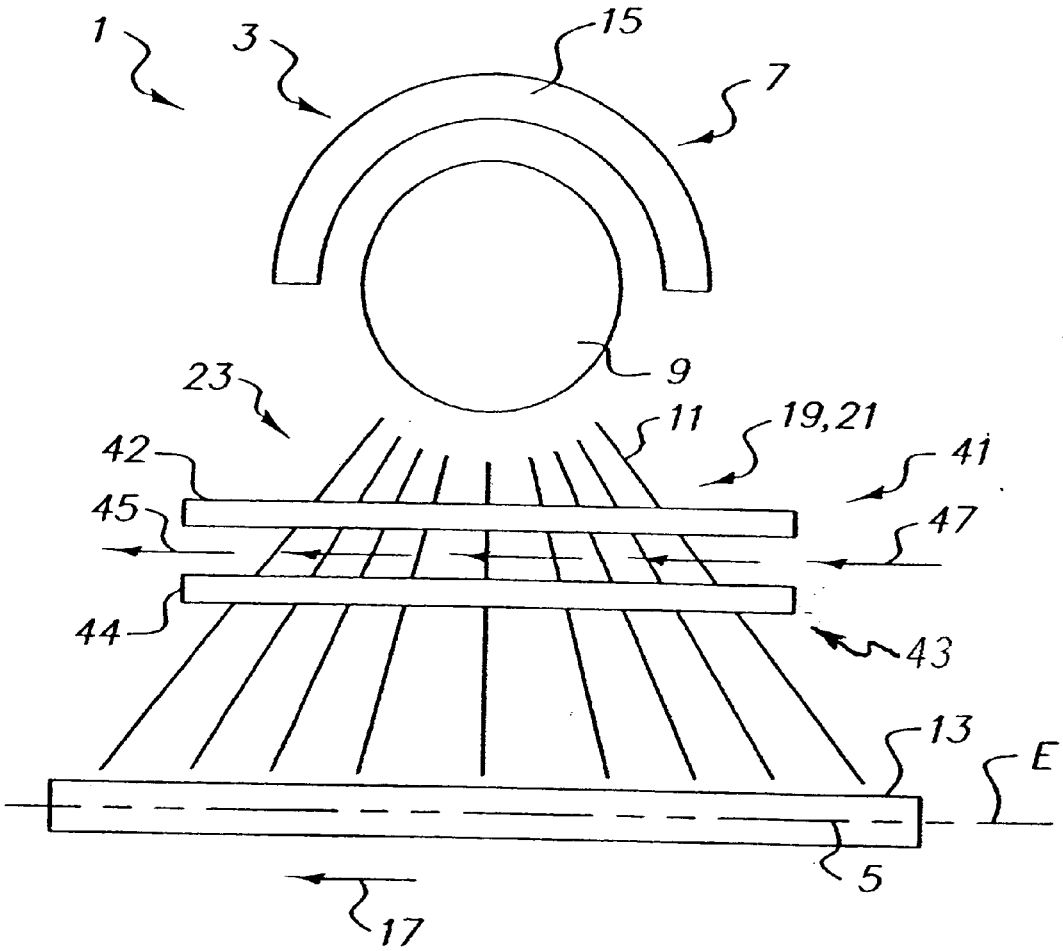
FIGS. 4 and 5 each show a section of an embodiment example of the protection device in a different arrangement within the fixing device.

FIG. 4 shows an additional embodiment example of the machine 1 with an additional example of the protection device 23. Parts that have already been described using the previous figures are provided with the same reference indicators so that in this regard reference is made to the description for these figures. The protection device 23 contains first and second protection elements 41, 43, which are each formed here from a thin plate 42, 44, which are arranged at a distance from each other and from the transport plane E of the paper 5. The plates 42 and 44 are oriented parallel to each other and to the transport plane E of the paper 5. The protection elements 41, 43 are made out of a radiation permeable material and have, in a preferred embodiment form, no throughput openings at least in the area of the radiation path 21. The flat side of the protection elements 41, 43 impinged with electromagnetic radiation is thus solid. The protection elements 41, 43 each consist of a material that, when the radiation device 7 is turned on, allows at least as much electromagnetic radiation through it from the radiation device 7 to the paper 5, so that the toner image located on it can be fused. The protection elements 41, 43 as in the embodiment examples of the protection device 23 described using FIGS. 1 to 3A/3B are arranged fixed in the radiation path 21, and can thus not be moved relative to the transport plane of the paper 5 or the radiation device 7, but instead are arranged in a position that stays constant.

Above the first protection element 41, the radiation device 7 is arranged, and on the opposite side of the second, lower protection element 43, the paper transport plane E is arranged. As indicated with arrows 45, the intermediate space 47 between the protection elements 41, 43 can be flushed continuously or at certain intervals with a gaseous medium, preferably with air, functioning for the cooling of the protection elements 41, 43.

The protection elements 41, 43 are preferably made out of a material that lets through it electromagnetic radiation with a wavelength $\lambda$ from approximately 0.2 $\mu$m to approximately 6 $\mu$m, preferably from 0.2 $\mu$m to 3.5 $\mu$m, and especially from 0.2 $\mu$m to 2.5 $\mu$m. The radiation spectrum lying outside of this range is absorbed by the protection elements 41, 43.

Based on the embodiment of the protection device 23 described in FIG. 4, the following function results: When the radiator 9 is turned off, the radiation device 7 emits UV to near infrared radiation 11 in the direction of the paper 5. Based on their embodiment according to the invention, the protection elements 41, 43 let through up to 95% of the radiation output emitted by the radiation device 7 when the radiation device 7 is turned on, so that the toner image located on the paper 5 is fused in the desired manner. Should an operating malfunction occur, such as a stop of the paper transport, the radiation device 7 is turned off, which preferably occurs automatically. The radiation device 7 then no longer emits UV to near infrared radiation 11, but instead only the temperature radiation of the parts that have been heated up by it when the radiation device 7 is turned on. The radiation device 7 then still radiates only in the infrared spectral range. After the radiation device 7 has been turned off, the wavelength of the radiation emitted changes with the falling temperature of the radiator 9 that is turned off, it is then namely above approximately 3.4 $\mu$m or more. This radiation spectrum is, however, almost completely absorbed by the protection elements 41, 43, so that when the radiation device 7 is turned off, in the end only approximately 10% of the initial energy of the residual heat radiation arrives on the paper 5. The large portion of the residual heat radiation is preferably absorbed by the first protection element 41 that lies opposite the radiation device 7, so that it has a clearly higher temperature than the second protection element 43 that lies opposite the paper transport plane E. The heating of the second protection element 43 is in each case only so high that upon a contact between the paper 5 and the second protection element 43, the paper 5 is not ignited. It is noted furthermore that the actual stop of the protection device 23 is formed only by the second protection element 43 on the underside of which the paper 5 can stop, for example, if it arches up in the direction of the radiation device 7 as a result of excessive heating. The protection elements 41, 43 thus have a double function, they function namely as a filter for a specific spectrum of the electromagnetic radiation and as a stopper for the paper.

In order to cool the protection elements 41, 43, so that at least the second protection element 43 is not heated above a critical temperature, at which it would ignite the paper 5 upon contact between the protection element 43 and the paper 5, the intermediate space 47 is flushed with air.

Figure 5:
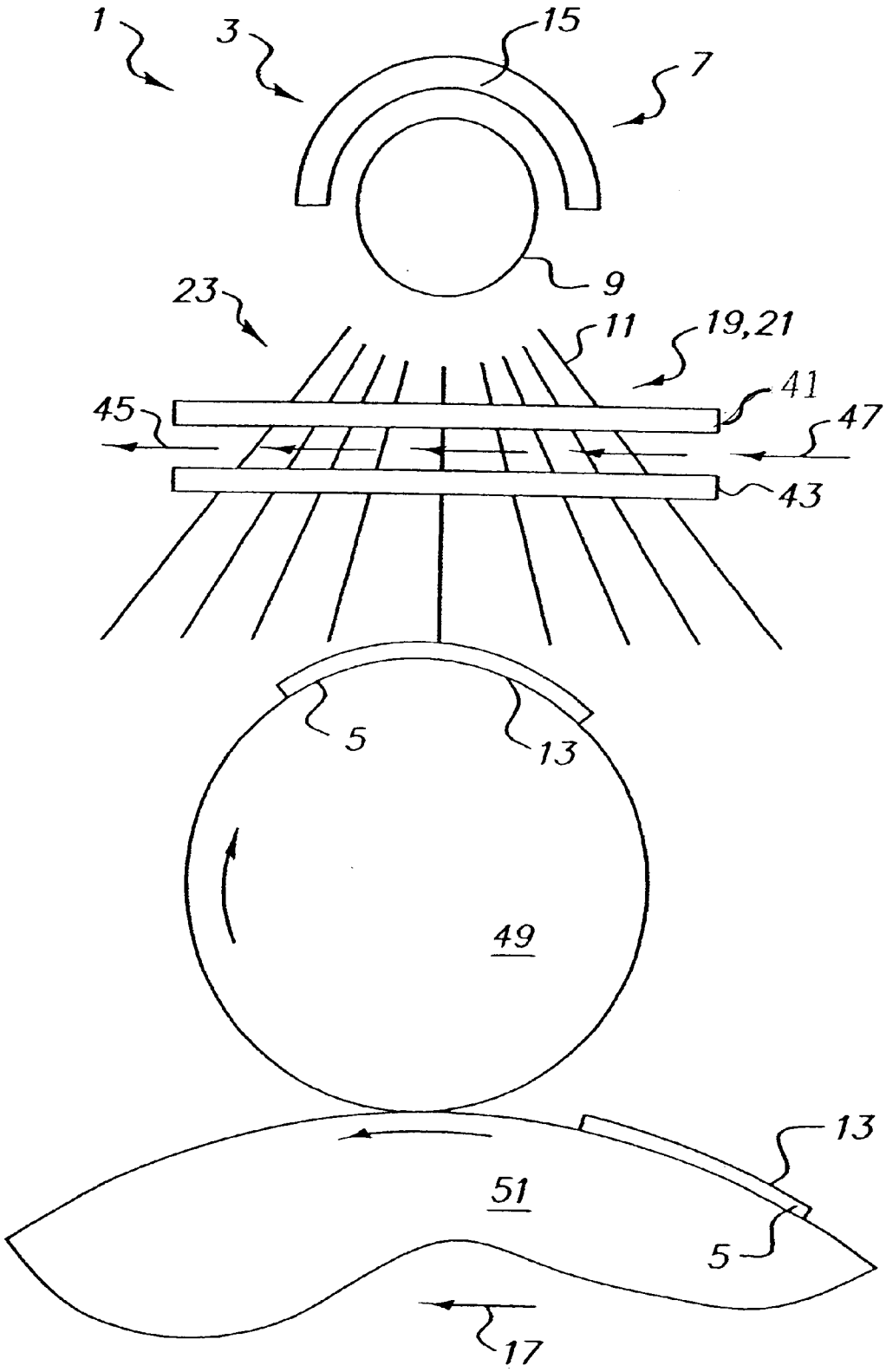

FIG. 5 shows a section from an additional embodiment example of the machine 1, in which the radiation device 7 is assigned a roller 49 that is heated from the outside by the radiation device 7. The heated roller 49 contacts, on its outer sheath, a cylinder 51 that functions for the transport of a paper 5 or is arranged at only a very small distance from it, so that only a very small gap exists between the cylinder 51 and the roller 49, through which the paper 5 with a toner image located on it is transported lying flat on the outer sheath of the cylinder 51. When the paper 5 runs through the cylinder/roller gap, the toner image located on a flat side 13 of the paper 5 is contacted in any case by the hot roller 49 and fused by it.

It can occur that the paper 5 stays stuck on the outer sheath of the hot roller 49 and by this gets to the radiation device 7 during a rotation of the hot roller 49, as shown in FIG. 5. In this case, the function of the protection device 23 consists in that it prevents the paper 5 from igniting when the roller 49 is at a standstill. An additional function of the protection device 23 is, during an operating malfunction in which the radiation device 7 is turned off and possibly the roller 49 is stopped, protecting the roller 49 from the residual heat radiation and thus from damage.

FIG. 5 shows a section from an additional embodiment example of the machine 1, in which the radiation device 7 is assigned a roller 49 that is heated from the outside by the radiation device 7. The heated roller 49 contacts, on its outer sheath, a cylinder 51 that functions for the transport of a paper 5 or is arranged at only a very small distance from it, so that only a very small gap exists between the cylinder 51 and the roller 49, through which the paper 5 with a toner image located on it is transported lying flat on the outer sheath of the cylinder 51. When the paper 5 runs through the cylinder/roller gap, the toner image located on a flat side 13 of the paper 5 is contacted in any case by the hot roller 49 and fused by it.

It can occur that the paper 5 stays stuck on the outer sheath of the hot roller 49 and by this gets to the radiation device 7 during a rotation of the hot roller 49, as shown in FIG. 5. In this case, the function of the protection device 23 consists in that it prevents the paper 5 from igniting when the roller 49 is at a standstill. An additional function of the protection device 23 is, during an operating malfunction in which the radiation device 7 is turned off and possibly the roller 49 is stopped, protecting the roller 49 from the residual heat radiation and thus from damage.

Common to all of the embodiment examples of the protection device 23, described in FIGS. 1 to 5, is that their protection elements and/or the at least one stopper 24, 31 are arranged fixed in the radiation path 21 between the radiation device 7 and the object to be heated (paper or roller 49), i.e., they are in a position that can not be changed and remains the same relative to the object to be heated and/or the radiation device 7. An expensive displacement device and control system for the displacement of these elements into the radiation path 21 during a malfunction of the printing or copying process, as provided in known protection devices, is rendered unnecessary in the protection device according to the invention. These protection and/or stopper elements also stay in the radiation path 21, during the fixing of the toner image on the paper 5, and thus do not hinder the fixing operation. The protection devices 23 have a simple and cost effective construction. It is advantageous furthermore that the protection devices 23 require almost no maintenance.

In summary, the protection device 23 within the printer or copier machine 1 can be arranged at any desired position in the radiation path 21 between a radiation device 7 and an object to be heated. The object can, for example, be a conveyor belt for the substrate, which is to be heated. The object can also be the substrate which itself, or possibly a toner image transferred onto it, should be preheated. The protection device 23 can thus be used universally and is not limited to the fixing device 3 of the printer or copier machine 1.

The embodiment examples are not to be understood as a restriction of the invention. Moreover, numerous alterations and modifications are possible in the context of the disclosure presented, in particular such variations, elements and combinations and/or materials, which, for example, by the combination or modification of individual characteristics and/or elements or process steps, described in connection with the general description and embodiment forms as well as claims, and contained in the drawings, can be ascertained by the expert in regard to the achieving the purpose and lead, through combinable characteristics, to a new object or to new process steps and/or process step sequences.

The invention has been described in detail with particular reference to certain preferred embodiments thereof, but it will be understood that variations and modifications can be effected within the spirit and scope of the invention.

What is claimed is:

1. Digital printer or copier machine (1) with a fixing device (3) for fixing a toner image onto a substrate (5), that is especially made of paper or cardboard and is guided along a transport plane (E) in a direction (17), where the fixing device (3) contains at least one radiation device (7), directing electromagnetic radiation (11) along a radiation path (21) for impinging at least one substrate side (13) with the electromagnetic radiation (11), and with a device (23) for protection against excessive heating of the substrate (5), characterized in that the protection device (23) has at least one stopper (24, 31) arranged fixed in the radiation path (21) between the at least one radiation device (7) and the transport plane (E) of the substrate (5), which prevents a contact between the substrate (5) and the at least one radiation device (7), said at least one stopper (24, 31) is made of at least one mesh structure (25) having only a low heating capacity and/or only low heat conductivity.

2. Printer or copier machine according to claim 1, characterized in that the at least one mesh structure (25) is located at a distance from the transport plane (E) of the substrate (5) and is oriented so that the at least one radiation device (7) is arranged on one side of the at least one mesh structure (25) and the transport plane (E) of the substrate (5) is arranged on the opposite side.

3. Printer or copier machine according to claim 1, characterized in that the at least one mesh structure (25) spans at least considerably the entire cross section of the radiation path (21).

4. Printer or copier machine according to claim 1, characterized in that the at least one mesh structure (25) is formed from at least one e preferably wide meshed mesh braid (27).

5. Printer or copier machine according to claim 4, characterized in that threads (29) of the at least one mesh structure (25) are made out of metal and/or heat resistant plastic and/or are formed from glass fibers or carbon fibers.

6. Printer or copier machine according to claim 5, characterized in that the threads (29) are made out of tungsten.

7. Printer or copier machine according to claim 5, characterized in that the threads (29) are made out of gold coated tungsten and the thread diameter (D)$\leqq$200 $\mu$m.

8. Printer or copier machine according to claim 5, characterized in that as seen in an overhead view of the transport plane (E) of the substrate (5), mesh braid (27) of the at least one mesh structure (25) is oriented in such a way relative to the transport plane (E) to the substrate (5) that its threads (29) are oriented at an angle to the transport plane (E), which is not equal to 90° and 0°.

9. Printer or copier machine according to claim 5, characterized by a tensioning device for applying tensile force, that is preferably adjustable, onto the threads (29).

10. Printer or copier machine according to claim 1, characterized in that the at least one mesh structure (25) is made out of several mesh braids (27) arranged on top of each other.

11. Printer or copier machine according to claim 10, characterized in that at least two mesh braids (27) have different mesh widths and/or their threads (29) are made out of different materials and/or different diameters (D).

12. Printer or copier machine according to claim 1, characterized in that the at least one stopper (24, 31) is made from a thin plate (33) that is arranged at a distance from the transport plane (E) of the substrate (5) and runs on edge to it or is inclined relative to the transport plane (E) of the substrate (5).

13. Printer or copier machine according to claim 12, characterized in that several plates (33) functioning as a stopper are provided, which are arranged next to each other as seen in the transport plane (E) of the substrate (5) and are at a distance from each other.

14. Digital printer or copier machine (1) with a fixing device (3) for fixing a toner image onto a substrate (5), that is especially made of paper or cardboard and is guided along a transport plane (E), where the fixing device (3) contains at least one radiation device (7), for impinging at least one substrate side (13) with electromagnetic radiation (11), and with a device (23) for protection against excessive heating of the substrate (5), characterized in that the protection device (23) has at least two radiation permeable protection elements (41, 43) arranged at a distance from each other in a radiation path (21) between the at least one radiation device (7) and the transport plane (E) of the substrate (5).

15. Printer or copier machine according to claim 14, characterized in that the at least two radiation permeable protection elements (41, 43) each consist of a material that lets through electromagnetic radiation at a wavelength ($\lambda$) from approximately 0.2 $\mu$m to approximately 6 $\mu$m, preferably from 0.2 $\mu$m to 3.5 $\mu$m, and in particular from 0.2 $\mu$m to 2.5 $\mu$m.

16. Printer or copier machine according to claim 14, characterized in that the at least one radiation device (7) emits ultraviolet radiation and/or visible to near infrared light when it is turned on.

17. Printer or copier machine according to claim 14, characterized in that an intermediate space (47) between the at least two radiation permeable protection elements (41, 43) can be flushed through by a gaseous medium, especially air, functioning to cool the at least two radiation permeable protection elements (41, 43).

18. Printer or copier machine according to claim 14, characterized in that the one protection element (41) of the at least two radiation permeable protection elements of the at least one radiation device (7) and the other of the protection element (43) of the at least two radiation permeable protection elements lies at a distance opposite the transport plane (E) of the substrate (5).

19. Printer or copier machine according to claim 14, characterized in that the at least two radiation permeable protection elements (41, 43) are each formed from one preferably thin plate (42, 44) that has no throughput openings.

20. Device (23), especially for a digital printer or copier machine (1), for protection against excessive heating of an object (5, 49) that is guided past a radiation device (7), characterized in that the protection device (23) has at least two protection elements (41, 43) arranged at a distance from each other and permeable to radiation, which are arranged in a radiation path (21) between the radiation device (7) and the object to be heated (5, 49).

21. Protection device according to claim 1, characterized in that the object (5, 49) is an image carrying substrate (5), and a cylinder or roller (49) that can be heated by the radiation device (7) and acts together with the substrate (5) for fixing a toner image that has been transferred onto it, or is a conveyor belt.

* * * * *